US005164878A

United States Patent [19]

Hauser

[11] Patent Number: 5,164,878

[45] Date of Patent: Nov. 17, 1992

[54] ORTHOPEDIC PAD

[76] Inventor: John P. Hauser, 1160 Bower Hil Rd. Apt. 1100B, Pittsburgh, Pa. 15243

[21] Appl. No.: 748,233

[22] Filed: Apr. 24, 1989

[51] Int. Cl.[5] ..... A61F 5/14

[52] U.S. Cl. ..... 36/145; 36/155; 36/166

[58] Field of Search ..... 128/586; 36/145, 155, 36/166

[56] References Cited

U.S. PATENT DOCUMENTS

| | | | |
|---|---|---|---|
| 2,221,202 | 11/1940 | Ratcliff | 36/155 |
| 3,265,071 | 8/1966 | Kirchner et al. | 128/586 |
| 4,346,525 | 8/1982 | Larsen et al. | 36/145 |

*Primary Examiner*—Richard J. Apley

*Assistant Examiner*—Lynne A. Reichard

*Attorney, Agent, or Firm*—Martin J. Carroll

[57] ABSTRACT

A resilient and compressible orthopedic pad adapted to be placed in a shoe under the longitudinal and metatarsal arches comprises a flat L-shaped bottom surface adapted to contact the inner sole of the shoe. One longitudinal side is substantially convex for the majority of its length and is adapted to roll up into the medial side of the shoe. The other longitudinal side is concave over the intermediate portion. The ratio of length to width of the pad is between approximately 1.3 and 1.5. The forward end of the pad is wider than its rear end. The forward end of the pad curves upwardly and rearwardly and the rear end curves upwardly and forwardly. Each longitudinal side curves upwardly towards the other longitudinal side.

7 Claims, 2 Drawing Sheets

ORTHOPEDIC PAD

This invention relates to orthopedic pads and more particularly to such pads for use within a shoe at the instep. In particular it is an improvement of the pad shown in Kirchner et al U.S. Pat. No. 3,265,071. The pad shown therein is still in successful use, but has the disadvantage that it is not suitable for use in wide shoes without modification. Also, the support for the medial arch is not as good as desired.

I have found that by increasing the length and the width of the pad, decreasing the ratio of length to width, and with some other modifications several advantages are obtained. For wide shoes the pad is so positioned that there is some roll up on the medial side of the shoe and for medium width shoes the pad is positioned for more roll up. In each case the roll up improves support for the medial arch. Greater comfort also results due to a larger area of contact at the plantar area of the foot.

It is therefore an object of my invention to provide a resilient, compressible orthopedic pad which will protect the longitudinal and metatarsal arches when inserted in a shoe of normal width or one of greater than normal width.

Another object is to provide such a pad having improved support for the medial arch.

A further object is to provide such a pad providing greater comfort.

These and other objects will be more apparent after referring to the following specifications and attached drawings in which.

Figure 1:
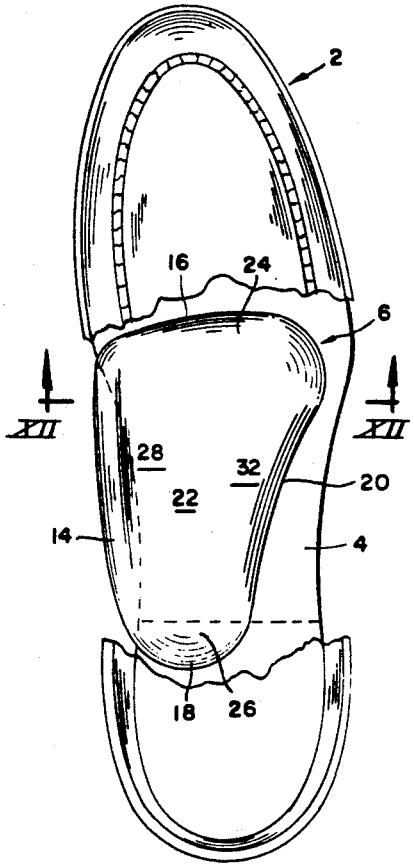
FIG. 1 is a top plan view of a right hand shoe with the pad of my invention positioned therein.
Figure 2:
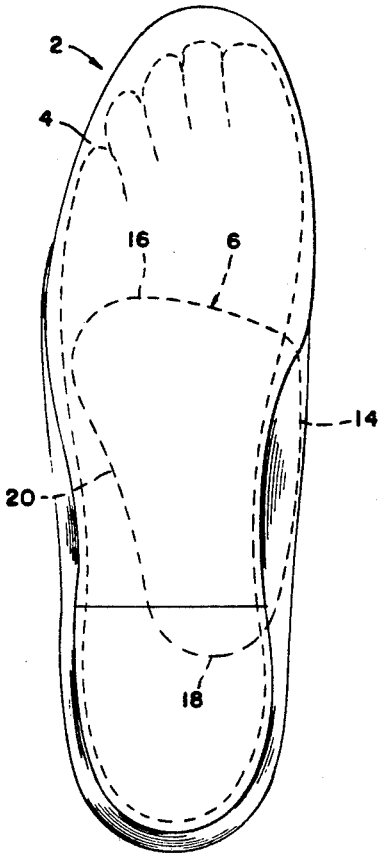
FIG. 2 is a plan view of the shoe and pad of FIG. 1 looking upwardly at the bottom of the shoe.
Figure 3:
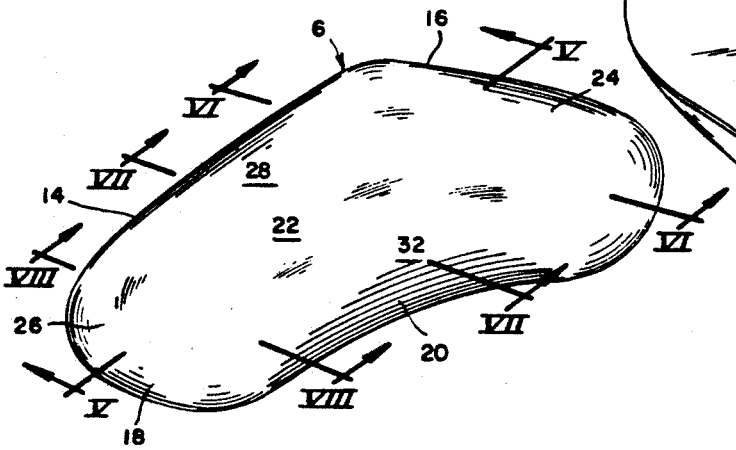
FIG. 3 is a perspective view of the pad of my invention.
Figure 4:
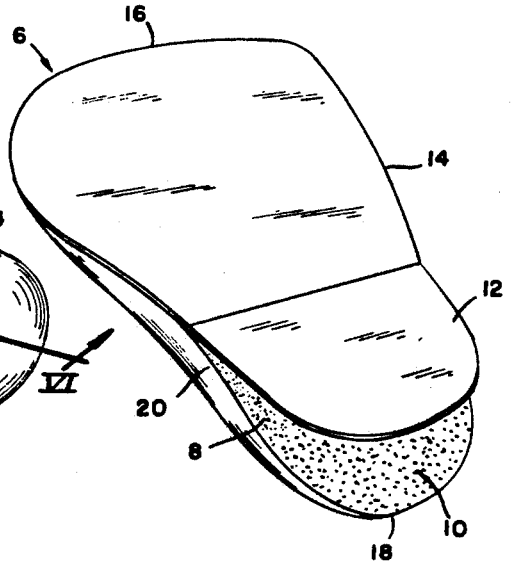
FIG. 4 is a perspective view of the pad of my invention looking at the bottom thereof.
Figure 5:
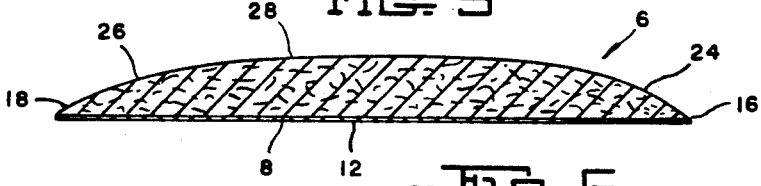
FIG. 5 is a view taken on the line V—V of FIG. 3.
Figure 6:
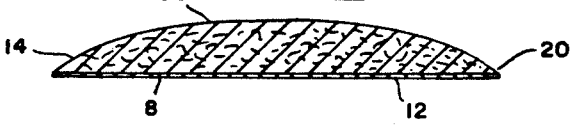
FIG. 6 is a view taken on the line VI-VII of FIG. 3.
Figure 7:
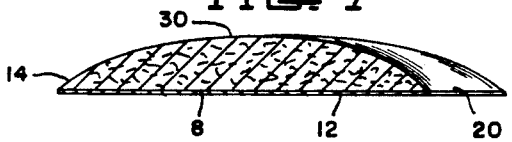
FIG. 7 is a view taken on the line VII—VII of FIG. 3.
Figure 8:
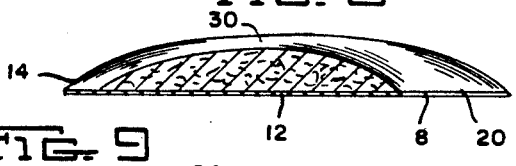
FIG. 8 is a view taken on the line VIII—VIII of FIG. 3.
Figure 9:
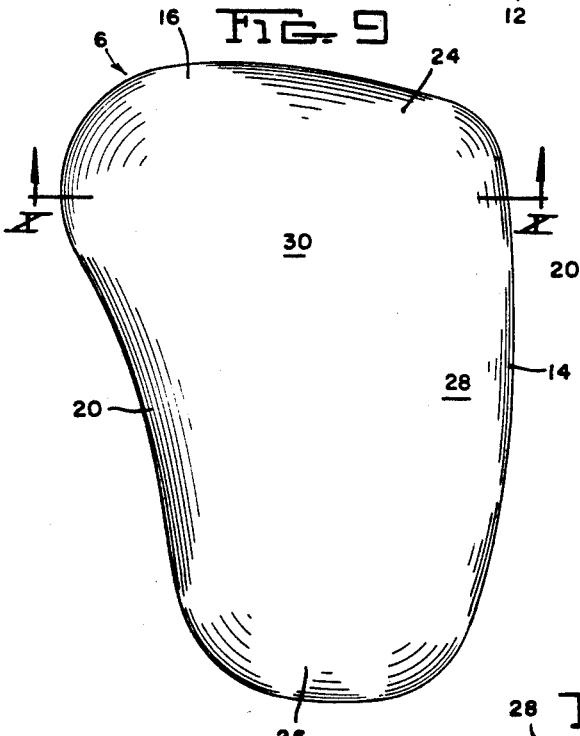
FIG. 9 is a top plan view of a left hand pad.
Figure 10:
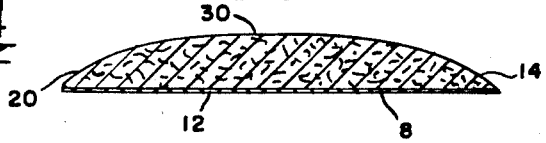
FIG. 10 is a view taken on the line X—X of FIG. 9.
Figure 12:
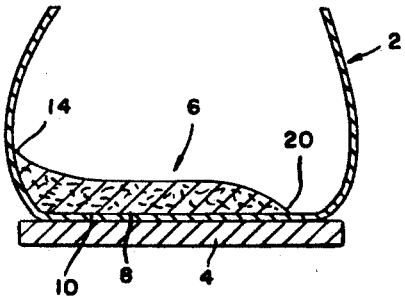
FIG. 12 is a view taken on the line XII—XII of FIG. 1.
Figure 11:
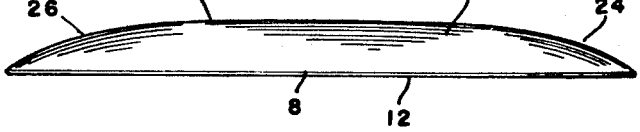
FIG. 11 is a view of the right side of the pad of FIG. 9.

Referring more particularly to the drawings, reference numeral 2 indicates a shoe having an innersole 4 upon which pad 6 of my invention rests. While a right hand shoe and pad are shown it will be understood that a pad of opposite hand will be provided for a left hand shoe.

The pad 6 has flat generally L-shaped bottom surface 8 which has a layer of adhesive 10 thereon. In order to prevent the pads from sticking together or to other surfaces a protective strip 12 is provided over the adhesive. The strip 12 may be made of paper or any other suitable material.

Longitudinal side 14 of bottom surface 8 is substantially convex for the majority of its length. Forward end 16 of surface 8 is substantially wider than rearward end

18. The other longitudinal side 20 of surface 8 is concave over its intermediate portion. The corners of the bottom surface are all rounded as shown. Upper surface 22 of pad 6 is contoured with forward end 24 curving upwardly and rearwardly to a maximum thickness at a distance between 20% and 30% of its total length from the forward end. This slope is preferably of a smaller angle than in the prior pad for improved comfort in the area of the first metatarsal.

Rearward end 26 curves upwardly and forwardly. A relatively straight portion 28 of top surface 30 connects the ends 24 and 26 adjacent longitudinal side 14. Top portion 32 adjacent the longitudinal side 20 is concave for between ⅛ and ½ of its length over the central part of the pad. The concavity is a minimum of approximately 3/16 inches which is more than the prior pad. I have found that necessary because of the increased width. The pad also curves upwardly along each longitudinal edge towards the opposite longitudinal edge. The ratio of length to width of the pad is between approximately 1.3 and 1.5. One particular pad is 3¼ inches wide at its widest point and 4½ inches long at its longest point.

In use in a normal width shoe the strip 12 is pulled off and the pad 6 placed on sole 4 with the flat surface 8 downwardly and the longitudinal side 14 extending up into the medial side of the shoe. This roll up into the shoe provides improved support for the medial arch. Because the pad covers more area than the previous pad it is more comfortable. Once positioned the pad is held in place by the glue.

With wider shoes, the pad is positioned more to the lateral side of the shoe and the roll up into the medial side of the shoe is less.

The pad is made of compressible resilient material such as felt. A soft felt is much preferred. Felt having a fiber content of 10% virgin wool, 48% reprocessed wool, 37% reused wool and 5% cotton is very satisfactory. Another suitable felt contains 5% viscose rayon fiber, 5% cotton, 90% wool fiber made up of 10% virgin wool, 67% reprocessed wool and 13% reused wool and weighs approximately 4 lbs. per square yard in ½ inch thicknesses.

The pad 6 may be made in various sizes depending on the size of the shoe.

Each size of the pad may be used with several different sizes of shoes. High heeled shoes require a smaller size pad than lower heeled shoes of the same size. The size of the pad may be varied by reducing the thickness thereof with the top contour otherwise being the same.

While one embodiment of my invention has been shown and described it will be apparent that other adaptations and modifications may be made without departing from the scope of the following claims.

I claim:

1. A resilient and compressible pad adapted to be placed in a shoe under the longitudinal and metatarsal arches of the foot, said shoe having an inner sole and a medial side; said pad comprising a flat generally L-shaped bottom surface adapted to contact the inner sole of the hose, one longitudinal side of said flat surface being substantially convex for the majority of its length and adapted to be positioned to roll up the medial side of the shoe, said surface having a substantial width for the majority of its length with the forward end being wider than the rearward end, the width of the pad at its widest point being at least three inches, the other longitudinal side of said flat surface having a pronounced concavity over the intermediate portion thereof, and adapted to be spaced from the adjacent side of the shoe and a contoured upper surface, the forward end of said pad curving upwardly and rearwardly to a maximum thickness, the portion of the pad adjacent each longitudinal side extending upwardly toward the opposite side, the rearward portion of the pad curving upwardly and forwardly, the top surface of the pad adjacent said other longitudinal side being concave over the central part thereof, the upper surface having a relatively straight portion adjacent said one longitudinal side sloping from the maximum thickness portion rearwardly and downwardly to the curved rearward portion, the ratio of length to width of the pad being between approximately 1.3 and 1.5.

2. A pad according to claim 1 in which the concavity of the other longitudinal side is a minimum of approximately 3/16 inch.

3. A resilient pad according to claim 2 in which the material of the pad is a felt made predominantly of wool.

4. A resilient and compressible one-piece pad according to claim 3 including an adhesive on said flat bottom surface, and a protective strip of material removably attached to said bottom surface by said adhesive.

5. A resilient pad according to claim 1 in which the material of the pad is a felt made predominantly of wool.

6. A resilient and compressible one-piece pad according to claim 5 including an adhesive on said flat bottom surface, and a protective strip of material removably attached to said bottom surface by said adhesive.

7. A pad according to claim 1 in which the width of said pad is wider than the inside width of said shoe.

* * * * *